US009214722B2

(12) United States Patent
Georgakopoulos et al.

(10) Patent No.: US 9,214,722 B2
(45) Date of Patent: Dec. 15, 2015

(54) ORIGAMI FOLDED ANTENNAS

(71) Applicants: Stavros Georgakopoulos, Boca Raton, FL (US); Emmanouil Tentzeris, Atlanta, GA (US); Benjamin Cook, Atlanta, GA (US)

(72) Inventors: Stavros Georgakopoulos, Boca Raton, FL (US); Emmanouil Tentzeris, Atlanta, GA (US); Benjamin Cook, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 103 days.

(21) Appl. No.: 14/278,703

(22) Filed: May 15, 2014

(65) Prior Publication Data

US 2014/0340275 A1 Nov. 20, 2014

Related U.S. Application Data

(60) Provisional application No. 61/823,690, filed on May 15, 2013.

(51) Int. Cl.

| | |
|---|---|
| ***H01Q 1/36*** | (2006.01) |
| ***H01Q 19/10*** | (2006.01) |
| ***H01Q 1/38*** | (2006.01) |
| ***H01Q 11/08*** | (2006.01) |

(52) U.S. Cl.

CPC . *H01Q 1/36* (2013.01); *H01Q 1/38* (2013.01); *H01Q 11/08* (2013.01); *H01Q 11/086* (2013.01); *H01Q 19/10* (2013.01); *Y10T 29/49016* (2015.01)

(58) Field of Classification Search

CPC ..... H01Q 11/086; H01Q 11/08; H01Q 1/36; H01Q 1/38

USPC ..... 343/895, 834

See application file for complete search history.

(56) References Cited

U.S. PATENT DOCUMENTS

| | | | | |
|---|---|---|---|---|
| 4,028,701 | A * | 6/1977 | Parks | H01Q 15/20 342/8 |
| 4,352,113 | A | 9/1982 | Labruyere | |
| D333,470 | S | 2/1993 | Vong | |
| D417,867 | S | 12/1999 | Hunt | |
| 6,791,510 | B2 * | 9/2004 | Watanabe | B64G 1/222 343/897 |
| 8,421,683 | B2 | 4/2013 | Mak et al. | |
| 8,446,326 | B2 | 5/2013 | Tietjen | |

* cited by examiner

*Primary Examiner* — Hoang V Nguyen

(74) *Attorney, Agent, or Firm* — Bryan W. Bockhop; Bockhop & Associates, LLC

(57) ABSTRACT

An antenna includes a dielectric sheet and a conductive film. The dielectric sheet is folded into a plurality of fold segments and is configured to be compressed into a compressed state and to be expanded into an expanded state. The conductive film is disposed on a portion of the dielectric sheet. The conductive film has a pattern that defines a current path from the bottom of the dielectric sheet to the top of the dielectric sheet. The pattern is configured so that the each of the plurality of fold segments includes a portion of the pattern and so that the portion of the pattern on each fold segment is substantially non-juxtaposed with respect to the portion of the pattern on each adjacent fold segment when the dielectric sheet is fully compressed into the compressed state.

20 Claims, 6 Drawing Sheets

ORIGAMI FOLDED ANTENNAS

CROSS-REFERENCE TO RELATED APPLICATION(S)

This application claims the benefit of U.S. Provisional Patent Application Ser. No. 61/823,690, filed May 17, 2013, the entirety of which is hereby incorporated herein by reference.

BACKGROUND OF THE INVENTION

1. Field of the Invention

The present invention relates to antennas and, more specifically, to origami folded antennas.

2. Description of the Related Art

There has been a large amount of work by mathematicians and engineers over the past two decades focusing on the mathematical foundations of origami and more generally folding and unfolding systems. The property of an object being able to unfold is often referred to as deployability, which can serve different purposes for various applications. For example, deployable antennas and solar panels are highly desirable in satellite and other space applications. In such applications, it is important for an antenna or solar panel to be able to fit into a small space, but also be expandable to a fully operational size once orbit has been achieved.

The issue of deployability of antennas is especially critical as the size of satellites gets smaller. While the sensors and operating electronics of miniaturized satellites can be scaled to extremely small volumes, the wavelengths of the signals used by such miniaturized satellites to communicate do no scale accordingly. Given that the wavelength of a signal determines the size of an antenna used to communicate that signal, antennas for miniaturized satellites must still have dimensions similar to those of larger satellites. Some of the advantage of satellite miniaturization is lost as a result of poorly deployable antennas.

Therefore, there is a need for highly deployable antennas that occupy small volumes prior to deployment.

SUMMARY OF THE INVENTION

The disadvantages of the prior art are overcome by the present invention which, in one aspect, is an antenna element that includes a dielectric sheet and a conductive film. The dielectric sheet, having a bottom and a top, is folded into a plurality of fold segments. The dielectric sheet is configured to be compressed into a compressed state and to be expanded into an expanded state. The antenna has a greater length along an axis when in the expanded state than when in the compressed state. The conductive film is disposed on a portion of the dielectric sheet. The conductive film has a pattern that defines a current path from the bottom of the dielectric sheet to the top of the dielectric sheet. The pattern is configured so that the each of the plurality of fold segments includes a portion of the pattern and so that the portion of the pattern on each fold segment is substantially non-juxtaposed with respect to the portion of the pattern on each adjacent fold segment when the dielectric sheet is fully compressed into the compressed state.

In another aspect, the invention is an antenna unit that includes a dielectric sheet, a conductive film and a ground element. The dielectric sheet has a bottom and a top, and is folded into an accordion-folded three dimensional shape elongated along an axis. The dielectric sheet has creases that are transverse to the axis. The three dimensional shape has a compressed state and an expanded state. The conductive film is disposed on a portion of the dielectric sheet. The conductive film has a pattern that defines a current path from the bottom of the dielectric sheet to the top of the dielectric sheet. The ground element is disposed adjacent to the bottom of the dielectric sheet.

In yet another aspect, the invention is a method of making an antenna, in which a conductive film is printed onto a dielectric sheet according to a pattern. The dielectric sheet is folded into a plurality of fold segments so that the dielectric sheet has a three dimensional shape and has a compressed state and an expanded state. Each of the plurality of fold segments includes a portion of the pattern. The portion of the pattern on each fold segment is substantially non-juxtaposed with respect to the portion of the pattern on each adjacent fold segment when the dielectric sheet is fully folded into the compressed state.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
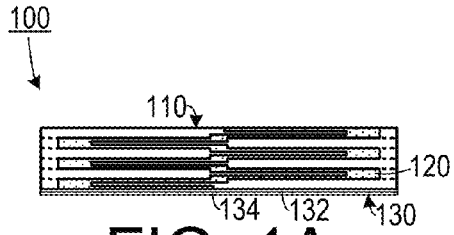
FIGS. 1A-1B are two schematic views of a first embodiment of a foldable antenna in a compressed state.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 1B:
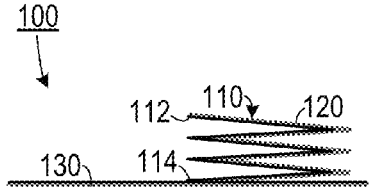
Figure 1C:
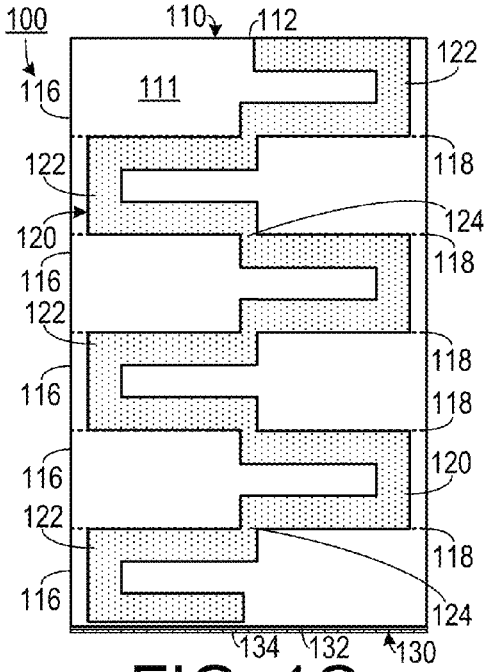
FIGS. 1C-1D are two schematic views of a first embodiment of a foldable antenna in an expanded state.
Figure 1D:
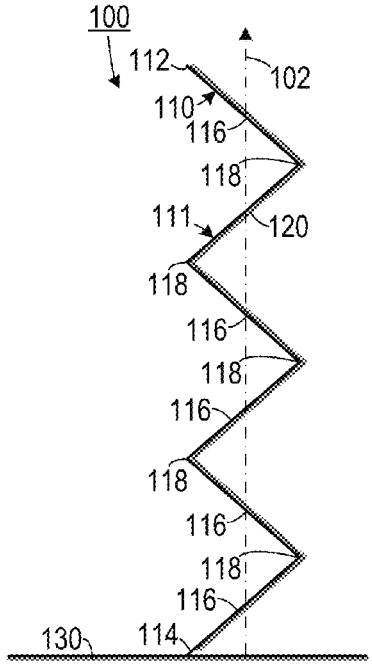

As shown in FIGS. 1A-1D, one embodiment of an antenna 100 includes an antenna element 110 and a ground plane element 130 (which could include, for example a dielectric plane 132 that is transverse to the antenna element 110 and that is disposed on a flat conductive surface 134). The antenna element 110 includes a dielectric sheet 111 (which could be made of such materials as a paper, a plastic, a nonwoven material, a fiberglass, one of the many other types of foldable dielectrics, and combinations of these materials), having a bottom 114 and a top 112, that is folded into a plurality of fold segments 116 along a plurality of creases 118 that run transversely in relation of the axis 102 of the antenna element 110. The dielectric sheet 111 is folded so as to be compressed into a compressed state (as shown in FIGS. 1A and 1B) and to be expanded into an expanded state (as shown in FIGS. 1C and 1D). As can be seen the antenna element 110 has a greater length along the axis 102 when in the expanded state than when in the compressed state.

A conductive film 120 is printed (or otherwise placed) on the dielectric sheet 111 in a pattern that defines a current path from the bottom 114 to the top 112 of the dielectric sheet 111. The pattern is arranged so that the each of the plurality of fold segments 116 includes a portion 122 of the pattern. Each portion 122 of the pattern on each segment 116 is substantially non-juxtaposed with respect to the portion 122 of the pattern on each adjacent fold segment 116 when the dielectric sheet is fully compressed into the compressed state (except for a connector portion 124 of the pattern that connects the portions 122 on the different segments 116). As a result, the portions 122 do not short each other out when the antenna element 110 is fully compressed.

The conductive film 120 can include any material that is both sufficiently conductive for antenna applications and is compatible with the dielectric sheet 111 (e.g., a metal, a metallized ink, a conductive polymer, a conductive oxide, etc. and combinations of these materials). The conductive film 120 is printed on the dielectric sheet 111 prior to folding. Examples of methods of printing can include ink jet printing and screen printing. The pattern can also be generated by covering the dielectric sheet 111 with a conductive film and then etching the pattern from the conductive film.

Figure 2A:
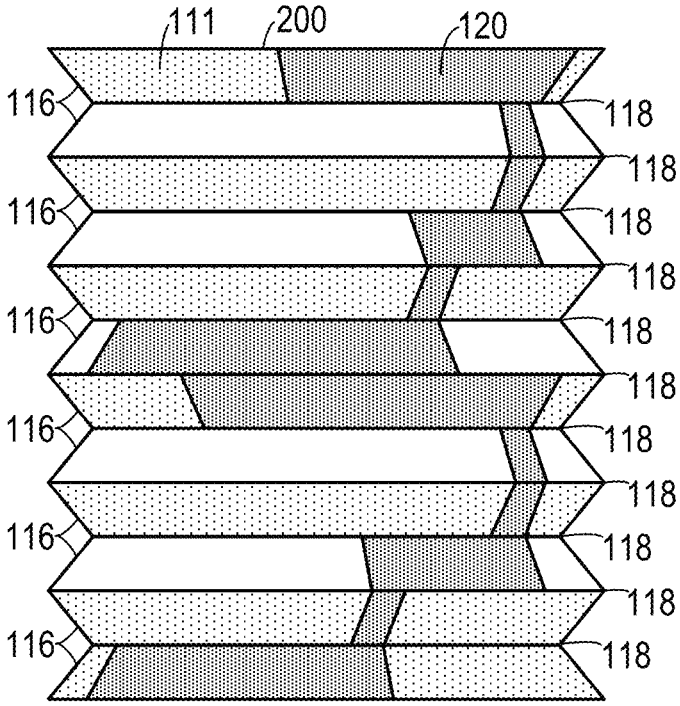
FIGS. 2A-2B are three schematic views for a second embodiment of a foldable antenna.
Figure 2B:
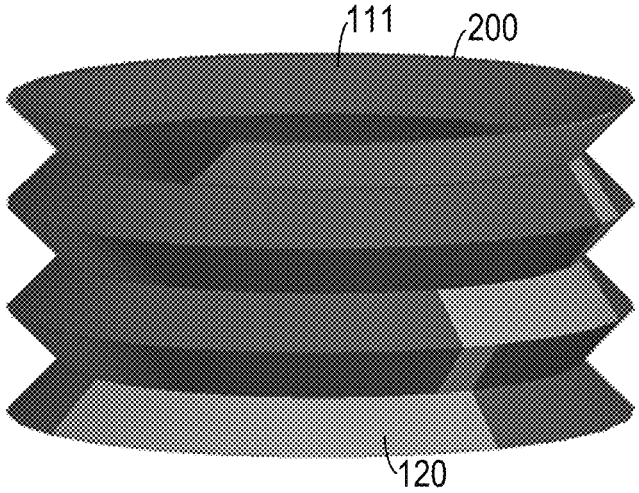
Figure 2C:
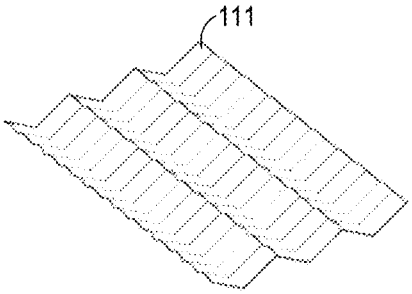
FIGS. 2C-2D are two schematic views showing one method of folding a dielectric sheet to achieve the embodiment shown in FIGS. 2A-2C.
Figure 2D:
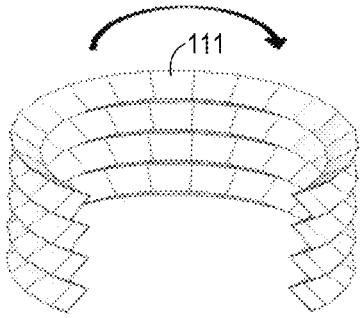

As shown in FIGS. 2A and 2B, the dielectric sheet 111 can be folded into a three dimensional shape, such as an accordion shaped antenna element 200 with a circular cross section using well know origami folding methods. As shown in FIG. 2C, one method of making this structure is by folding the dielectric sheet 111, after having printed the conductive film thereon, to achieve the crease pattern shown. Then the rows are folded and the sheet 111 is folded into a cylindrical shape, as shown in FIG. 2D.

Figure 3A:
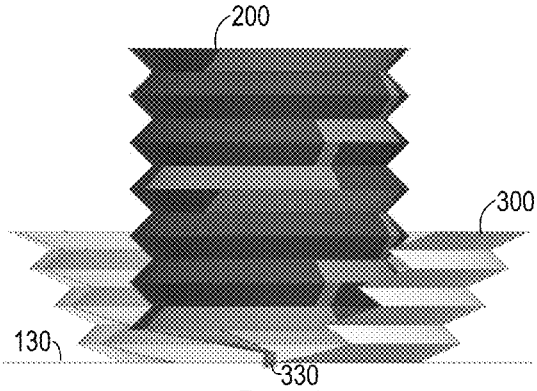
FIGS. 3A-3B are two schematic views of a foldable antenna with a foldable reflector unit.
Figure 3B:
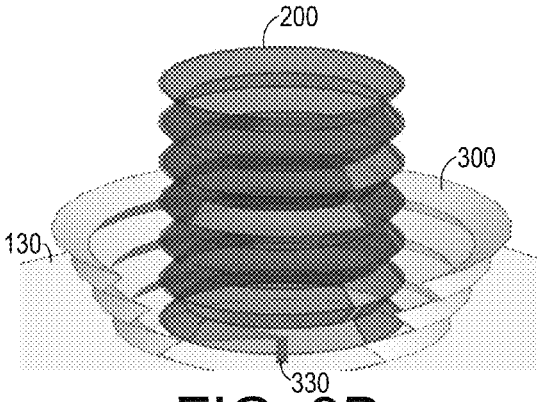

As shown in FIGS. 3A and 3B, a compressible reflector element 300 (which can also include a conductive material) may also be used with the antenna element 200. These figures also show an antenna feed point 330 that can be used to couple the antenna element 200 to a transceiver (not shown).

Figure 4A:
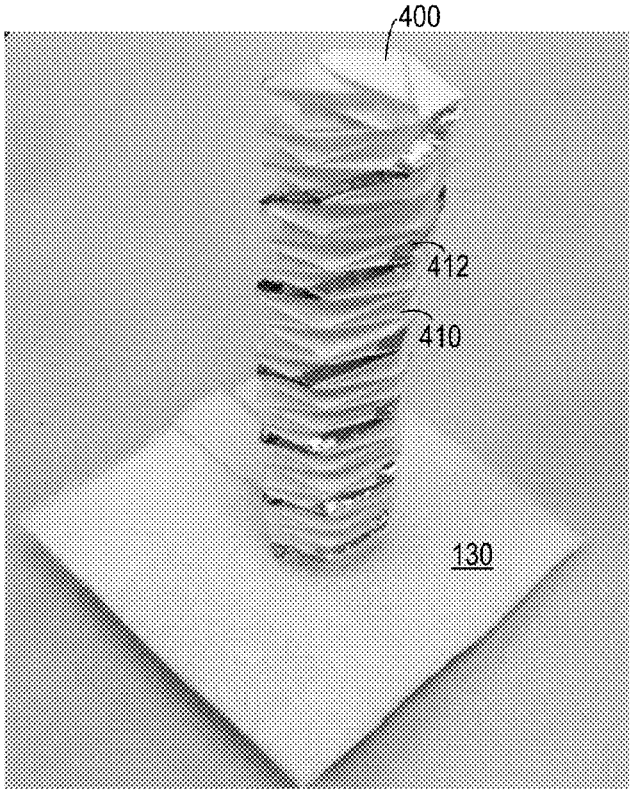
FIG. 4A is a photograph of a helically-folded antenna embodiment.
Figure 4B:
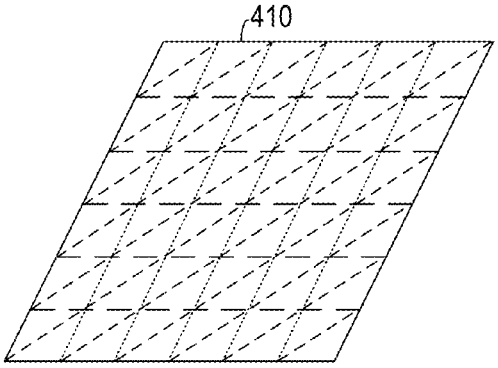
FIG. 4B is a schematic diagram of a dielectric sheet with a fold pattern used to make the embodiment shown in FIG. 4A.
Figure 4C:
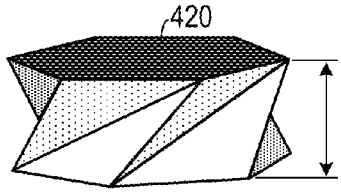
FIG. 4C is a schematic diagram of one unit cell of the embodiment shown in FIG. 4A.

As shown in FIG. 4A, a compressible helical antenna 400 with a polygonal cross section can be made by folding the dielectric sheet 410 into a helical pattern. In the figure shown, the conductive film 412 wraps around the helical antenna 400 as it progresses from bottom to top. A folding plan for the dielectric sheet 410 is shown in FIG. 4B and a single unit cell 420 of the helix is shown in FIG. 4C.

Figure 5A:
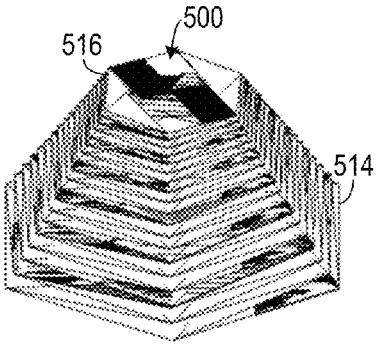
FIG. 5A is a schematic diagram of a conically shaped folded antenna in a compressed state.
Figure 5B:
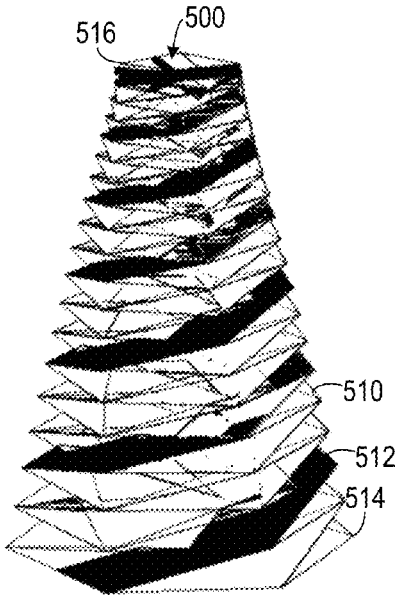
FIG. 5B is a schematic diagram of the antenna shown in FIG. 5A in an expanded state.

A conical embodiment of an antenna element 500 is shown in FIGS. 5A and 5B. In this embodiment, the dielectric sheet 510, with the conductive film 512 thereon, is folded into a conical section shape having a cap 516 radius and a base 514 radius in which the cap radius is less than the base radius.

Figure 6:
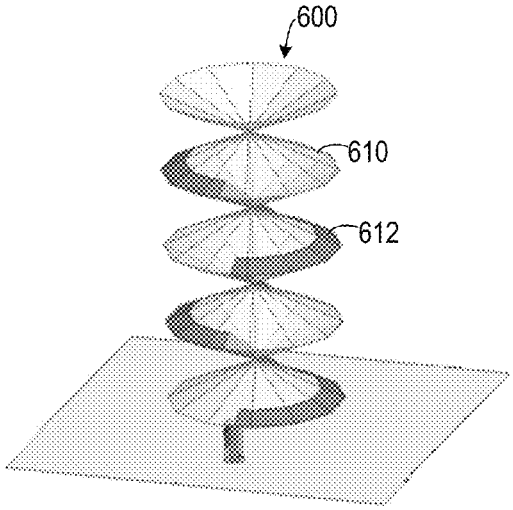
FIG. 6 is a schematic diagram of a spring type antenna embodiment.

A spring type embodiment of an antenna 600 is shown in FIG. 6. In this embodiment dielectric sheets 610 are folded into opposing polyhedral shapes with a conductive film 612 disposed thereabout. This embodiment has the advantage of being quite springy while still compressible.

Figure 7A:
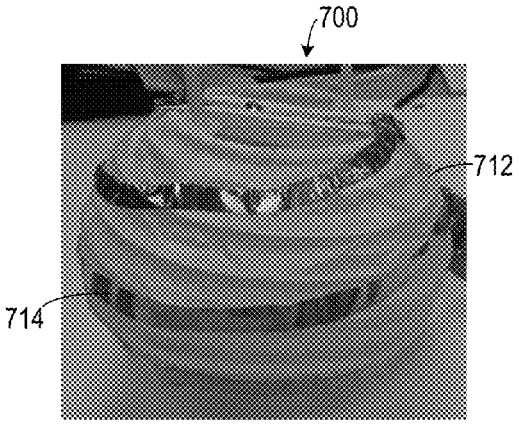
FIG. 7A is a photograph of a spherical antenna embodiment.
Figure 7B:
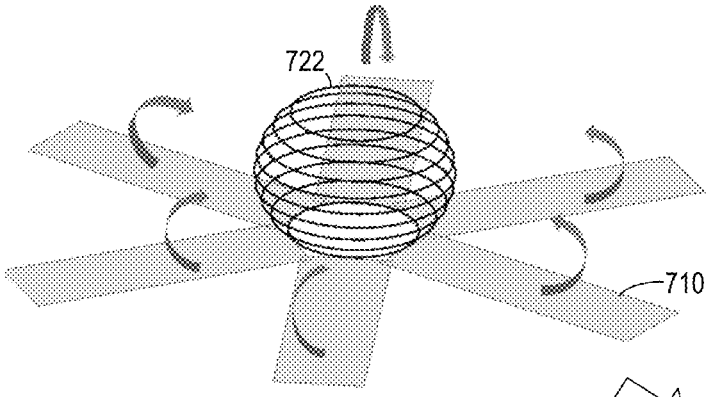
FIGS. 7B-7C are a schematic diagrams demonstrating construction of the embodiment shown in FIG. 7A.
Figure 7C:
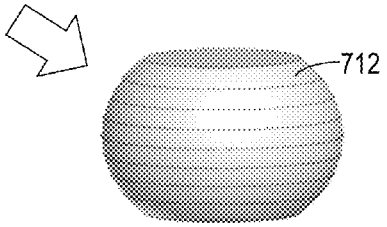

A spherical (or "lantern shaped") embodiment of an antenna element 700 is shown in FIG. 7A, in which a dielectric skin 712 is formed into a sphere and a conductive strip 714 is disposed around the sphere in a spiral. As shown in FIGS. 7B-7C, this embodiment may be made by wrapping dielectric strips 710 around a support structure 722 (such as the wire structure shown) and adhering them thereto with an adhesive, so as to render the spherical shape shown in FIG. 7C. The conductive strip 714 can then be applied about the spherical shape.

As would be understood by those of skill in the art, many different dielectric geometries can be used within the scope of this invention. Also, many different shapes of the conductive film can be employed to achieve different antenna characteristics within the scope of this invention.

These embodiments have the advantage of being deployable and also tunable. The gain of the antennas can be tuned and the antennas can be tuned to specific frequencies by adjusting the amount of expansion of the antenna element to a state that is between a fully compressed state and a fully expanded state.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An antenna element, comprising:

(a) a dielectric sheet, having a bottom and a top, folded into a plurality of fold segments so that the dielectric sheet is configured to be compressed into a compressed state and to be expanded into an expanded state wherein the antenna has a greater length along an axis when in the expanded state than when in the compressed state; and (b) a conductive film disposed on a portion of the dielectric sheet, the conductive film having a pattern that defines a current path from the bottom of the dielectric sheet to the top of the dielectric sheet, the pattern configured so that the each of the plurality of fold segments includes a portion of the pattern and so that the portion of the pattern on each fold segment is substantially non-juxtaposed with respect to the portion of the pattern on each adjacent fold segment when the dielectric sheet is fully compressed into the compressed state.

2. The antenna element of claim 1, wherein the dielectric sheet comprises a material consisting of: a paper; a plastic; a glass fiber material; and combinations thereof.

3. The antenna element of claim 1, further comprising a ground element disposed adjacent to the bottom of the dielectric sheet.

4. The antenna element of claim 3, wherein the ground element comprises a flat conductive surface.

5. The antenna element of claim 3, wherein the ground element comprises a conductive foldable three dimensional shape that is configured to act as a reflector.

6. The antenna element of claim 1, wherein the dielectric sheet is folded into an elongated three dimensional shape that is elongated along an axis and in which at least a set of the fold segments include creases that are transverse to the axis.

7. The antenna element of claim 6, wherein the dielectric sheet is folded into an accordion shape with a circular cross section transverse to the axis.

8. The antenna element of claim 6, wherein the dielectric sheet is folded into a helical shape with a polygonal cross section transverse to the axis.

9. The antenna element of claim 6, wherein the dielectric sheet is folded into a conical section shape having a cap radius and a base radius in which the cap radius is less than the base radius.

10. An antenna unit, comprising:

(a) a dielectric sheet, having a bottom and a top, folded into an accordion-folded three dimensional shape elongated along an axis and having creases that are transverse to the axis, the three dimensional shape having a compressed state and an expanded state; and (b) a conductive film disposed on a portion of the dielectric sheet, the conductive film having a pattern that defines a current path from the bottom of the dielectric sheet to the top of the dielectric sheet; and (c) a ground element disposed adjacent to the bottom of the dielectric sheet.

11. The antenna unit of claim 10 that has been expanded to a preselected expansion so as to tune the antenna element to a preselected frequency.

12. A method of making an antenna, comprising the steps of:

(a) printing a conductive film onto a dielectric sheet according to a pattern; and (b) folding the dielectric sheet into a plurality of fold segments so that the dielectric sheet has a three dimensional shape and has a compressed state and an expanded state so that the each of the plurality of fold segments includes a portion of the pattern and so that the portion of the pattern on each fold segment is substantially non-juxtaposed with respect to the portion of the pattern on each adjacent fold segment when the dielectric sheet is fully folded into the compressed state.

13. The method of claim 12, wherein the printing step comprises a selected one of printing using ink jet printing and printing using screen printing.

14. The method of claim 12, wherein the dielectric sheet comprises a material consisting of: a paper; a plastic; a glass fiber material; and combinations thereof.

15. The method of claim 12, further comprising the steps of:

(a) folding a conductive sheet into a reflector; and (b) disposing the reflector underneath the three dimensional shape.

16. The method of claim 12, further comprising the step of tuning the antenna by adjusting expansion of the dielectric shape between the compressed state and the expanded state.

17. The method of claim 12, wherein the three dimensional shape is elongated along an axis and in which at least a set of the fold segments include creases that are transverse to the axis.

18. The method of claim 17, wherein the folding step comprises folding the dielectric sheet into an accordion shape with a circular cross section transverse to the axis.

19. The method of claim 17, herein the folding step comprises folding the dielectric sheet into a helical shape with a polygonal cross section transverse to the axis.

20. The method of claim 17, herein the folding step comprises folding the dielectric sheet into a conical section shape having a cap radius and a base radius in which the cap radius is less than the base radius.

* * * * *